US007526931B2

(12) United States Patent
Burdett et al.

(10) Patent No.: US 7,526,931 B2
(45) Date of Patent: May 5, 2009

(54) SECURITY DEVICE FOR MEDIA CASE AND METHOD

(75) Inventors: Ronald K. Burdett, Strasburg, OH (US); Kevin Kirtz, Massillon, OH (US)

(73) Assignee: Nexpak Corporation, Duluth, GA (US)

( * ) Notice: Subject to any disclaimer, the term of this patent is extended or adjusted under 35 U.S.C. 154(b) by 0 days.

(21) Appl. No.: 11/283,411

(22) Filed: Nov. 17, 2005

(65) Prior Publication Data

US 2006/0124481 A1 Jun. 15, 2006

Related U.S. Application Data

(60) Provisional application No. 60/691,083, filed on Jun. 16, 2005, provisional application No. 60/628,609, filed on Nov. 17, 2004.

(51) Int. Cl.
*E05B 65/00* (2006.01)
*B65D 85/57* (2006.01)

(52) U.S. Cl. ..... 70/57.1; 70/57; 70/58; 70/63; 206/1.5; 206/308.2; 206/387.11

(58) Field of Classification Search ..... 70/57, 70/57.1, 58, 63, 158–162, 276; 206/1.5, 206/308.2, 387.11
See application file for complete search history.

(56) References Cited

U.S. PATENT DOCUMENTS

| | | | | |
|---|---|---|---|---|
| 3,581,979 | A | 6/1971 | Fuchs | |
| D274,796 | S | 7/1984 | Humble | |
| 4,805,769 | A | 2/1989 | Soltis | |
| 4,819,797 | A | 4/1989 | Holmgren | |
| 5,119,940 | A | 6/1992 | Grindrod | |
| 5,293,994 | A | 3/1994 | Antik | |
| 5,588,315 | A * | 12/1996 | Holmgren | 70/57.1 |
| 5,636,535 | A | 6/1997 | Shimada | |
| 5,732,822 | A | 3/1998 | Mitsuyama | |
| 5,802,890 | A | 9/1998 | Espada-Velasco | |
| 6,006,941 | A | 12/1999 | Hitchings | |
| D426,835 | S | 6/2000 | Tanimura | |
| 6,082,156 | A | 7/2000 | Bin | |
| 6,135,280 | A | 10/2000 | Burdett | |
| D436,016 | S | 1/2001 | Gould | |
| 6,226,839 | B1 | 5/2001 | Sayegh | |
| 6,311,531 | B1 | 11/2001 | Sykes | |
| 6,412,633 | B1 | 7/2002 | Costa | |
| 6,443,303 | B1 | 9/2002 | Seki | |
| 6,467,318 | B1 | 10/2002 | Gattiker | |

(Continued)

FOREIGN PATENT DOCUMENTS

| | | |
|---|---|---|
| WO | WO 93/15294 A | 8/1993 |

(Continued)

*Primary Examiner*—Patricia L Engle
*Assistant Examiner*—Christopher Boswell
(74) *Attorney, Agent, or Firm*—Zollinger & Burleson Ltd.

(57) ABSTRACT

The present invention provides a security device and method for securing a media case. The security device may include a hinged pair of closure members, which when closed define a substantially rectangular aperture for receiving a media case to be secured with a close fit. The closure members include an internal protrusion that extends within a portion of the substantially rectangular aperture that coincides with a finger cavity portion of a media case. The closure members include a latch opposite the side including the internal protrusion.

18 Claims, 14 Drawing Sheets

U.S. PATENT DOCUMENTS

| | | | | |
|---|---|---|---|---|
| D468,621 | S | 1/2003 | Farrar | |
| 6,516,639 | B1 * | 2/2003 | Margetts et al. | 70/57.1 |
| D477,983 | S | 8/2003 | Burdett | |
| 6,666,330 | B2 * | 12/2003 | Sedon et al. | 70/57.1 |
| 6,729,653 | B1 | 5/2004 | Greer | |
| D492,321 | S | 6/2004 | Farrar | |
| 6,814,225 | B2 | 11/2004 | Belden | |
| 6,832,498 | B2 * | 12/2004 | Belden et al. | 70/57.1 |
| 6,926,164 | B1 * | 8/2005 | Broadhead et al. | 70/57.1 |
| 7,028,836 | B2 * | 4/2006 | Hsiao et al. | 70/57.1 |
| D522,791 | S | 6/2006 | Ho | |
| 7,100,402 | B2 * | 9/2006 | Holmgren | 70/57.1 |
| 7,194,880 | B2 | 3/2007 | Necchi | |
| 2002/0194888 | A1 | 12/2002 | Mitsuyama | |
| 2003/0051517 | A1 | 3/2003 | Aarts | |
| 2004/0187530 | A1 * | 9/2004 | Lax et al. | 70/57.1 |
| 2005/0098455 | A1 * | 5/2005 | Hsiao et al. | 206/308.2 |

FOREIGN PATENT DOCUMENTS

| | | | |
|---|---|---|---|
| WO | WO 03/102336 | A1 * | 12/2003 |

* cited by examiner

SECURITY DEVICE FOR MEDIA CASE AND METHOD

CROSS REFERENCE TO RELATED APPLICATIONS

This application claims priority from U.S. provisional patent application Ser. No. 60/691,083 filed Jun. 16, 2005, and U.S. provisional patent application Ser. No. 60/628,609 filed Nov. 17, 2004; the disclosures of which are incorporated herein by reference.

BACKGROUND OF THE INVENTION

1. Technical Field

The invention herein described relates generally to a security device and method for preventing the opening of a media case thereby to prevent or deter theft.

2. Background Information

Various types of cases are known for holding information storage media and particularly disc-shaped data carriers, such as CDs and DVDs. The cases typically have two halves, e.g., a base and a lid, that are hingedly connected together so that the case may be opened and closed. Many of these cases have on the side thereof opposite the hinge a lock and/or finger cavity that is spaced inwardly from opposite ends of the case. The lock and/or finger cavity may be used to accommodate a lock inserted into the case to hold the case closed, or simply to provide a finger grip for easy opening of the case.

A problem encountered with such known cases is removal and theft of a CD or DVD from the case within a store selling such products. The disc case is often provided with a security tag which triggers an alarm if the container is taken out of the store without the tag first being removed or rendered inactive by staff in the store. The disc case may also be provided with a clear plastic wrapper that must be removed before the case may be opened. Thieves, however, have been able to slit the wrapper along an edge of the container, e.g. the bottom edge, and remove the CD or DVD from the case by compressing the case so that the side walls bow to form a gap between the two halves thereof so the CD or DVD may be slid out through the slit made in the wrapper. An experienced thief is able to remove the CD or DVD while pretending to examine the product and slip the CD or DVD into a coat pocket unobserved. They then leave the empty case on the shelf and leave the store with the CD or DVD in their pocket without triggering the alarm system.

To avoid such thefts, many stores only display empty cases. When a customer has made a selection, a staff member retrieves the relevant CD or DVD from a secure cupboard or safe and places it in the case for the customer. This process consumes additional time and requires an additional secure storage place for the CDs and DVDs. This process also increases the risk that the wrong CD or DVD may be put in the case. The stores thus would prefer for the discs to be held within the cases on display as this is more appealing to a potential customer than an empty case.

Prior art devices for increasing the security of such cases tend to be bulky and expensive. One known form of device comprises a "keeper" in the form of a robust casing or frame that fits around the exterior of the case and is locked in a closed position so it is impossible to open the case without first unlocking and removing the keeper. While effective, such keepers are difficult to handle and substantially increase the size of the product (often increasing the size of the product by 30% or more and so occupying more shelf space). Such keepers also require a substantial amount of space for storage when not in use.

WO97/02569 describes another form of security device in which one edge of the case is inserted into a channel shaped keeper which fits over the edge of the product and extends at least part way over opposite external faces of the case to prevent the case from being opened. Such a keeper is still a relatively complex and expensive item, which adds significantly to the external dimensions of the case and prevents the case from being stood on its bottom edge.

SUMMARY OF THE INVENTION

The present invention provides a security device and method for preventing the opening of a media case thereby to prevent or deter theft, and which device and method afford one or more advantages over prior art security devices and methods. One configuration of the security device is a simple device that is less costly to manufacture and therefore may be sold for less cost than prior art keepers, thereby making the device particularly suitable for use in protecting against theft of used DVDs and other media. The device may be adapted for use with any media case including a cavity, such as a locking and/or finger cavity, in the side wall thereof. In addition, the device is easy to use and is reusable.

According to one aspect of the invention, a security device is provided for preventing opening of a media case that has two halves that are hinged together at one side of the case so that the case may be opened and closed, and which case has on the side thereof opposite its hinged side a lock and/or finger (or other) cavity that is spaced inwardly from opposite ends of the case. The security device includes a pair of closure members hinged together at adjacent ends thereof for movement of the closure members between open and closed positions, and a latch for releasably holding the closure members in their closed position. The closure members in their closed position together define an elongated aperture for receiving a media case to be secured with a close fit. The closure members have at their hinged ends a protrusion projecting into a narrow end of the aperture in spaced relation to opposed longer sides of the aperture, whereby the closure members may be latched closed around a middle region of the media case when closed with the protrusion projecting into the cavity to prevent the security device from being slid off the media case.

In another configuration, the invention provides a security device for a media case; the security device comprising: first and second closure members each having a hinge end and a latch end; the first and second closure members being hinged together at their hinged ends; the first closure member carrying a catch and the second closure member carrying a lock finger; one of the catch and lock finger being movable to an inward position that allows the first and second closure members to be closed without having the lock finger lock to the catch; and the catch or lock finger disposed in the inward position being moved to an outer position by the media case when the media case is inserted into the security device; the outer position allowing the lock finger to lock with the catch when the security device is closed.

In a further configuration, the invention provides a releasable security device comprising a hinged pair of closure members which when closed define a substantially rectangular aperture for receiving a media case to be secured with a close fit, the closure members including an internal protrusion extending within a portion of the substantially rectangular aperture and a latch opposite the side including the internal protrusion.

According to another aspect of the invention, there is provided a method of securing a media case having a base and a lid hinged together at one side of the case and a finger (or other) cavity on the side opposite the hinge side. The method comprises the step of securing a pair of closure members around the media case with an inwardly extending protrusion engaging within the cavity to prevent the closure members from being slid off the case.

BRIEF DESCRIPTION OF DRAWINGS

These and further features of the present invention will be apparent with reference to the following description and drawings, wherein.

Similar numbers refer to similar parts throughout the specification.

DETAILED DESCRIPTION

Figure 1:
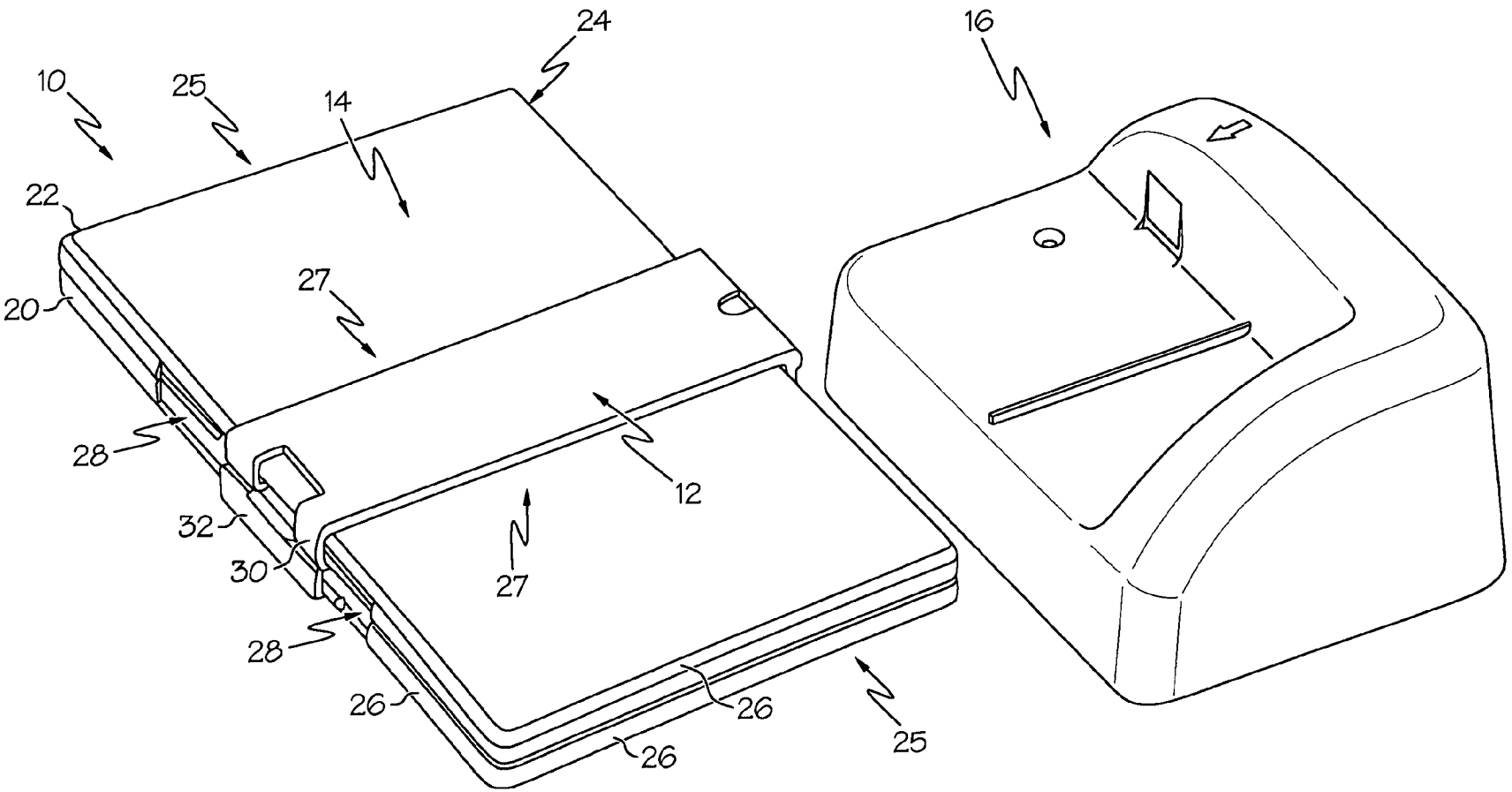
FIG. 1 is a perspective view of a media case security system in accordance with an exemplary embodiment of the present invention.

In the detailed description that follows, corresponding components have been given the same reference numerals regardless of whether they are shown or described in connection with different embodiments of the present invention. To illustrate the present invention in a clear and concise manner, the drawings may not necessarily be to scale and certain features may be shown in somewhat schematic form.

An exemplary media case security system according to the present invention is indicated generally by the numeral 10 in the accompanying drawings. As described below with respect to exemplary embodiments, security system 10 includes a security device 12, which may be installed, locked or otherwise releasably engaged onto a media case 14. Security device 12 may be unlocked or otherwise disengaged from the media case using a key 16. As is described more fully below, key 16 may be a mechanical key, a magnetic key, an electric key, or some combination of a mechanical key, magnetic key and electric key.

While security device 12 is described in connection with an exemplary media case 14, it is to be appreciated that the security device may be adapted for use with any media case having a cavity in the side of the case opposite the hinged side of the case.

As illustrated in FIG. 1, the exemplary media case 14 includes a base 20 and a lid 22 that are joined by a hinge 24 that allows for relative pivoting of the base 20 and the lid 22 between a closed condition and an open condition. The hinge may include a hinge wall and a pair of living hinges, although other types of hinges may be used if desired. At least one of the base and the lid may include latches, detents or other releasable fastening means to hold the media case closed independently of security device 12, as when security device 12 has been removed by an attendant at a retail store. Base 20, lid 22 and hinge 24 of the media case 14 may be formed of a unitary construction, for example, by molding the same from plastic material.

One or both of base 20 and lid 22 may include sidewalls 26 that extend along three sides of the base and/or lid. The sidewalls may include reinforcing ribs. In one embodiment, base 20 and lid 22 may each include sidewalls that abut and/or engage when the case is closed. Alternatively, one of the base or the lid may include sidewalls that overlap sidewalls of the other of the lid and the base when the case is closed.

When case 14 is closed (as illustrated in FIG. 1) the sidewalls of base 20 and/or lid 22 define a cavity 28 (also herein referred to as a locking cavity, a finger cavity or a recess) in the side of the case opposite the hinged side. As shown, cavity 28 is spaced and terminated inwardly from opposite ends of the case. In some embodiments, the ends of cavity 28 terminate at wall surfaces extending substantially perpendicular to the adjacent exterior surface of case 14.

When closed, the base and the lid define an enclosed space for the retention of recorded and/or printed media. As is understood in the art, base 20 and/or lid 22 may provide recorded media retention functionality and/or literature retention functionality. For example, the base may include a recorded media retention device, such as a hub (e.g., a "pluck-type hub" or a "push button hub") for retaining media discs, such as CDs or DVDs, while the lid may include one or more literature retention devices, such as literature clips for retaining printed literature, such as an instruction booklet. The hub or other recorded media retention device may be configured and adapted to removably retain in a secure manner one or more items of recorded media, e.g., DVDs, CDs, cartridges, game cartridges, flash cards, media cards, media keys, and other types of electronic readable media. Other types of recorded media retention devices include opposed resilient clips or tabs that cooperate to hold the recorded media to the panel, a pocket into which the recorded media may be inserted, etc.

While exemplary media case 14 is described above as having a base and a lid, it is to be appreciated that media cases, in connection with which the security device is applicable, may include intermediate pages or panels disposed between the base and the lid. Such a construction is understood by those of ordinary skill in the art and will not be described in detail. Exemplary media cases in connection with which the security device is applicable include the media case described in U.S. Pat. Nos. 5,788,068 and 6,196,384, the disclosures of which are incorporated herein by reference in their entireties.

For purposes of the discussion below, each media case may be thought of as having two opposite ends 25 and a middle region 27.

Figure 2:
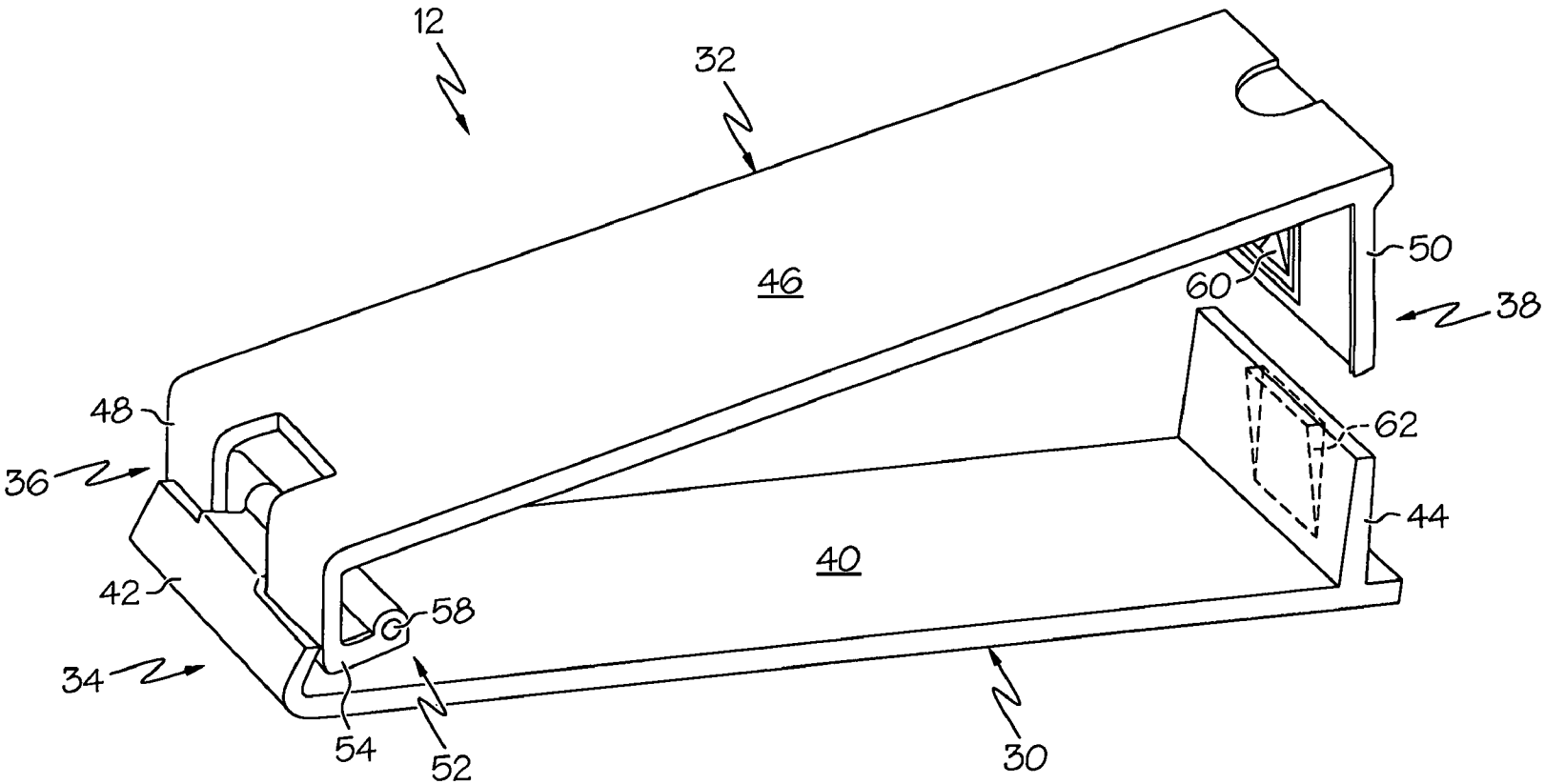
FIG. 2 is a perspective view of a security device in accordance with an exemplary embodiment of the present invention.
Figure 3:
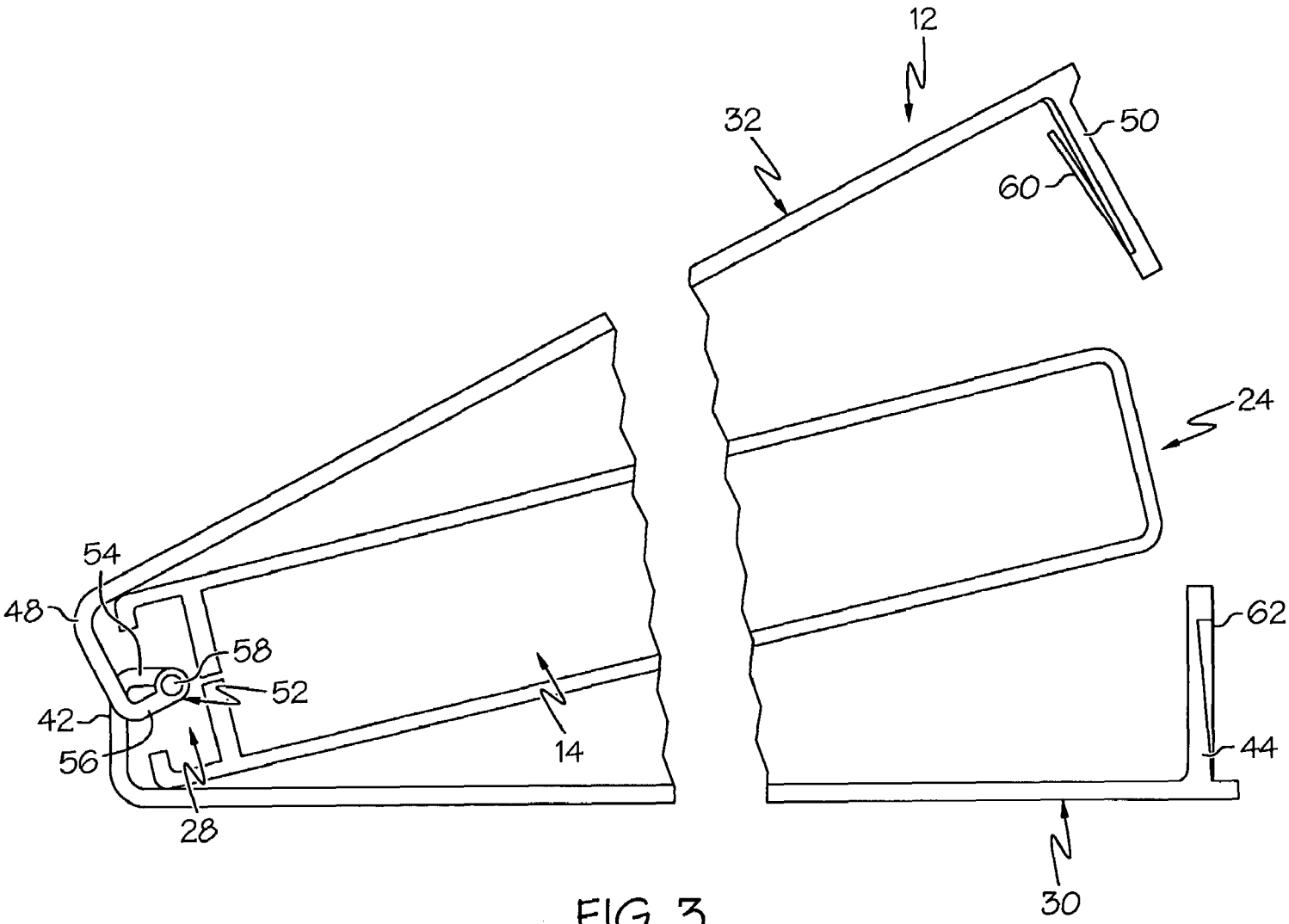
FIG. 3 is a cross-sectional view of a security device partially installed on a media case in accordance with an exemplary embodiment of the present invention.
Figure 4:
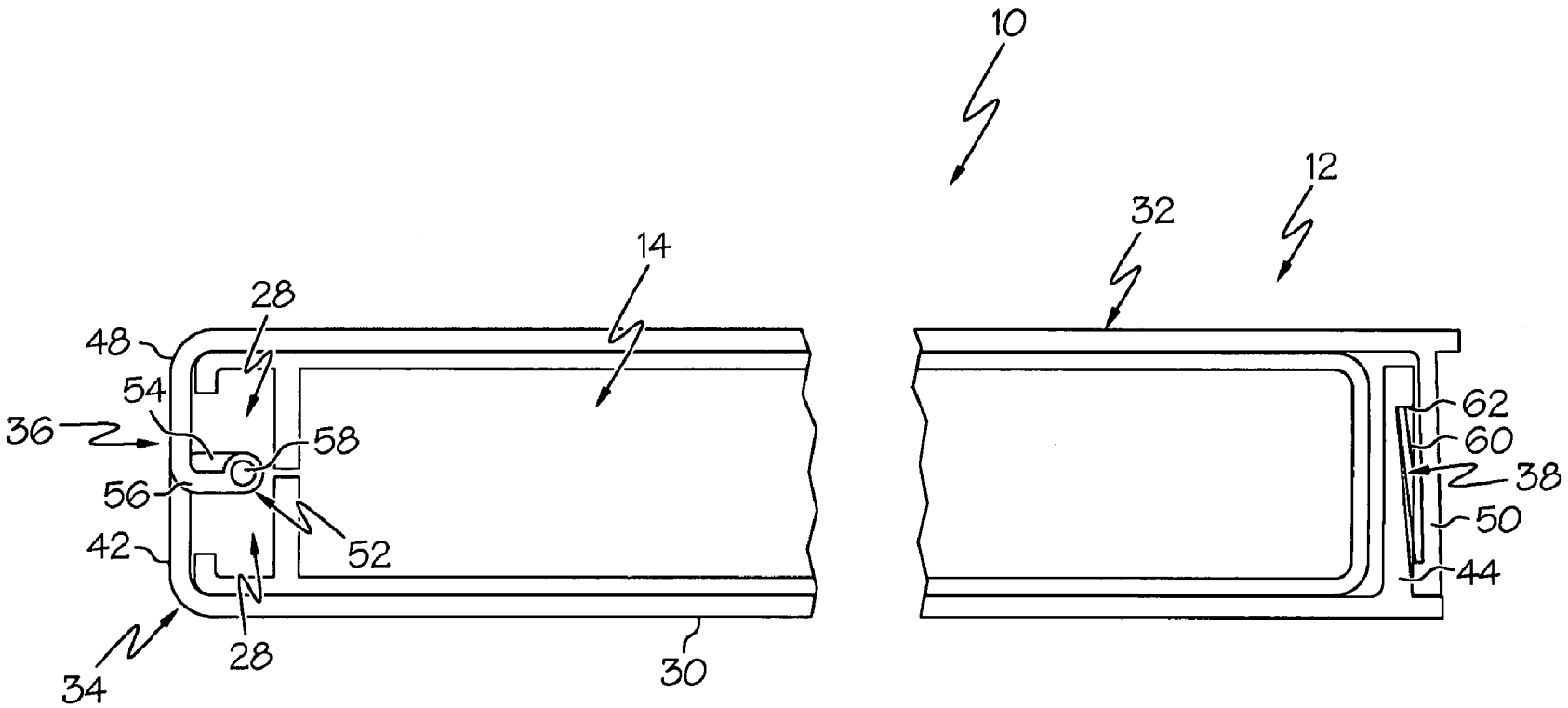
FIG. 4 is a cross-sectional view of a security device installed and locked on a media case in accordance with an exemplary embodiment of the present invention.
Figure 5:
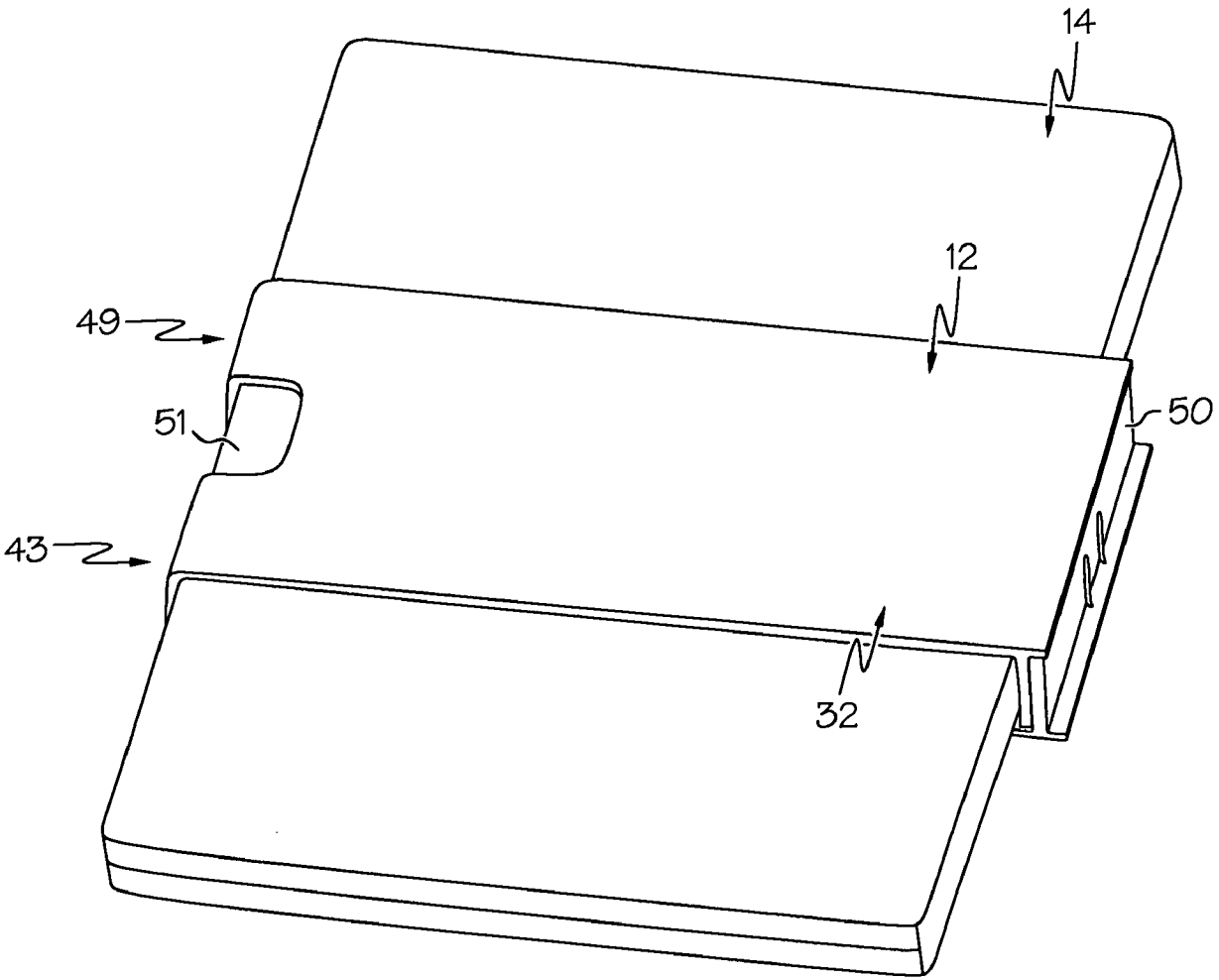
FIG. 5 is a perspective view of a security device installed and locked on an exemplary media case in accordance with another exemplary embodiment of the present invention.
Figure 6:
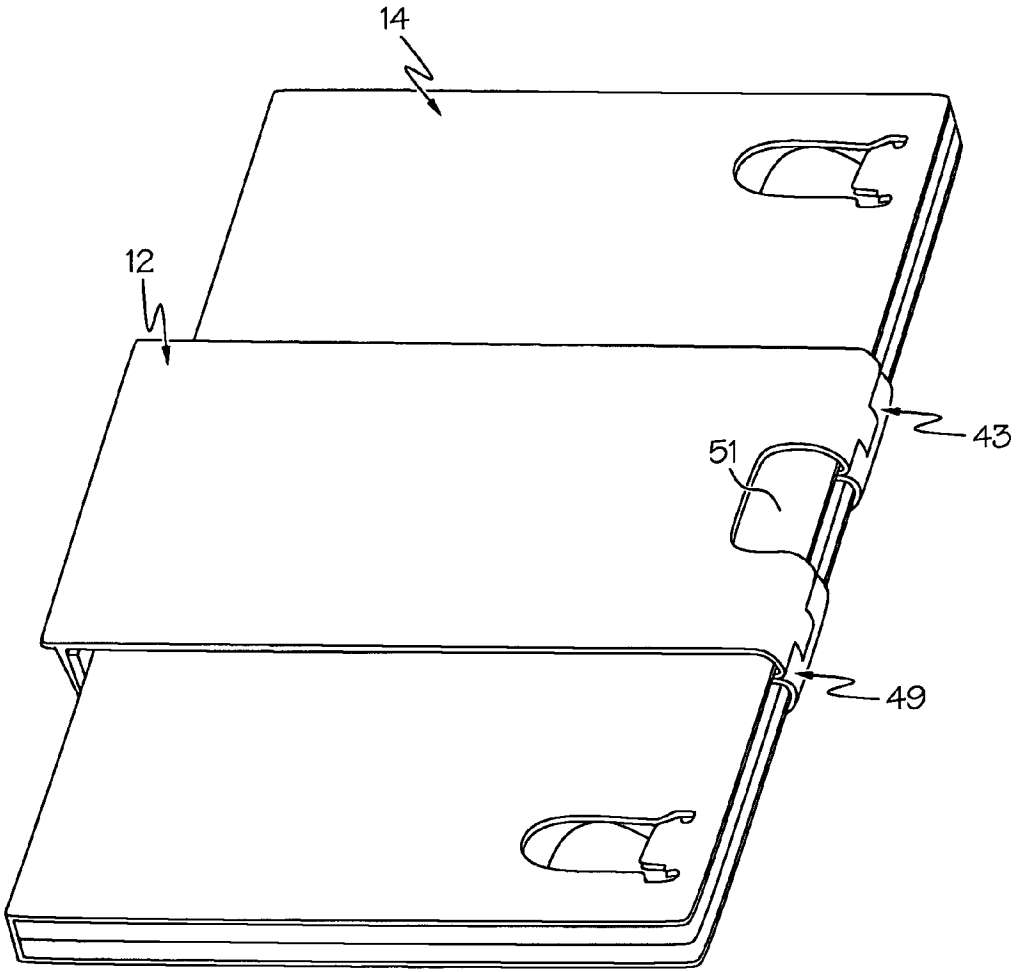
FIG. 6 is a perspective view of a security device installed and locked on another exemplary media case in accordance with another exemplary embodiment of the present invention.
Figure 7:
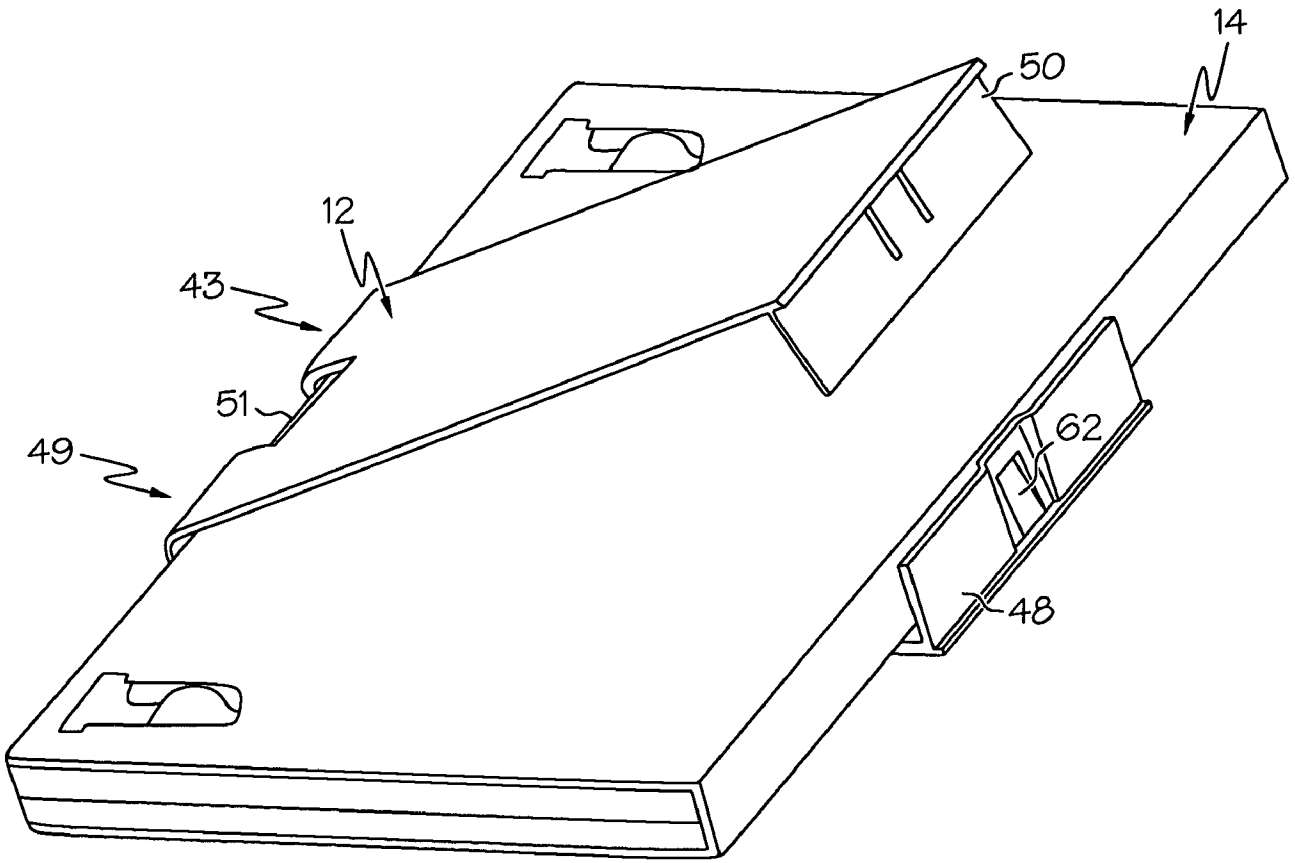
FIG. 7 is a perspective view of a security device partially installed on a media case in accordance with another exemplary embodiment of the present invention.
Figure 8:
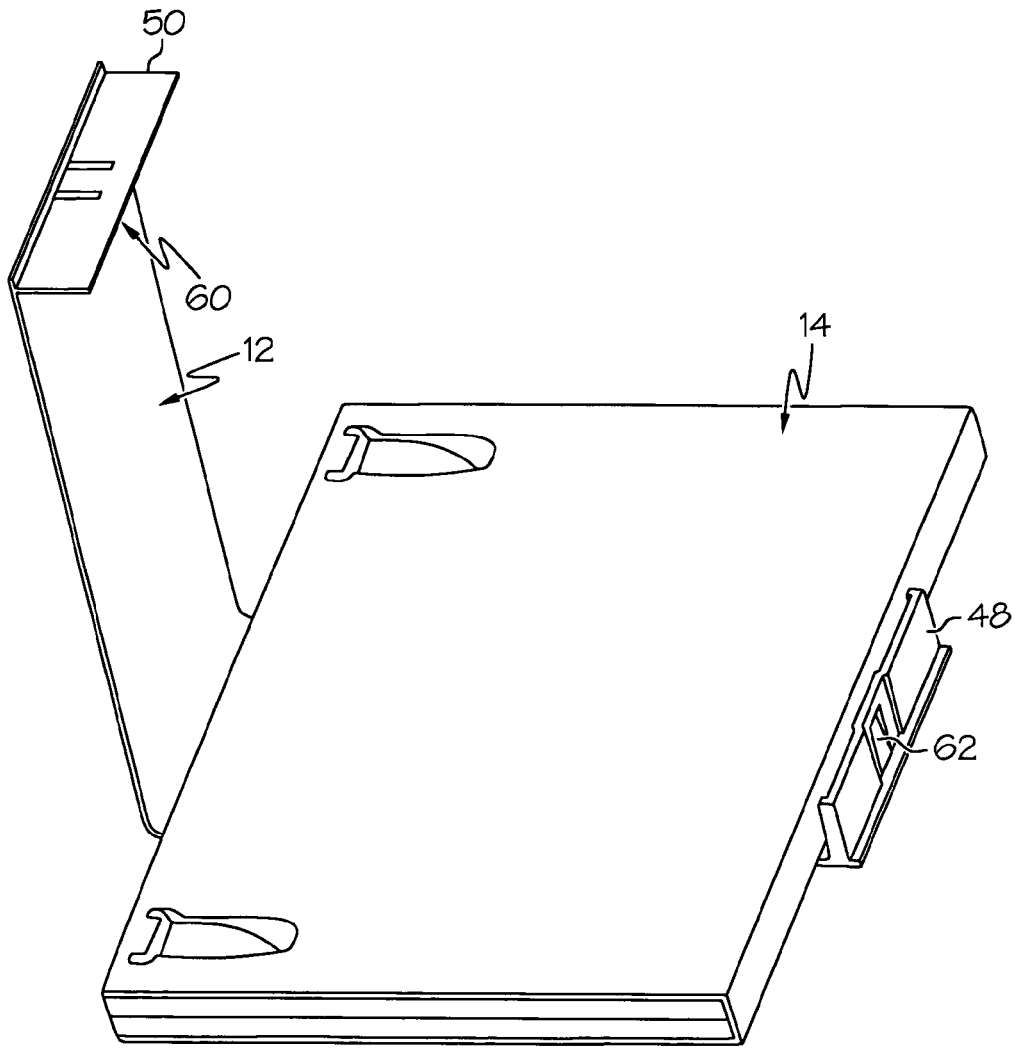
FIG. 8 is a perspective view of a security device partially installed on a media case in accordance with another exemplary embodiment of the present invention.
Figure 9:
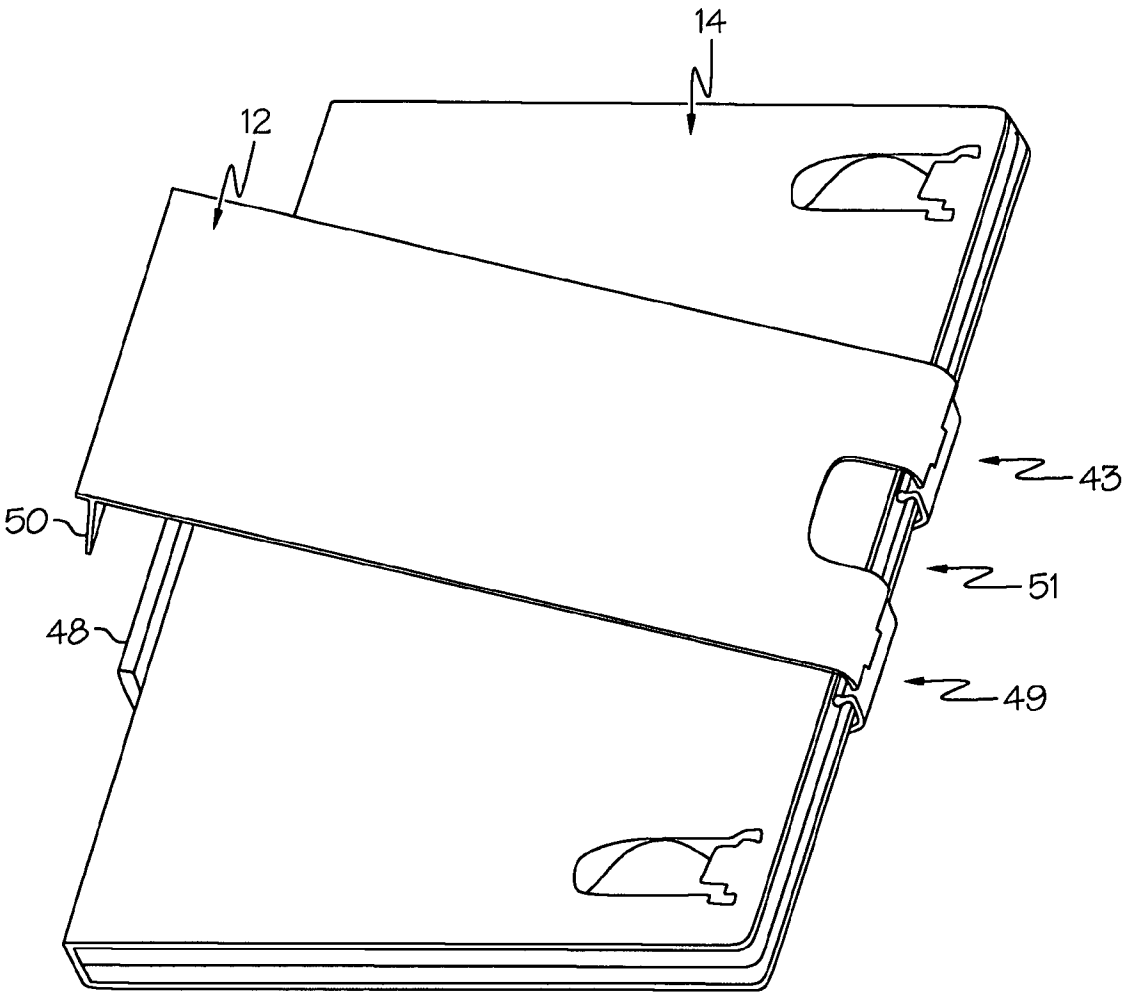
FIG. 9 is a perspective view of a security device partially installed on a media case in accordance with another exemplary embodiment of the present invention.

With reference now to FIGS. 2-4 and continued reference to FIG. 1, an exemplary embodiment of a security device 12 is provided. The security device may include a pair of closure members 30 and 32 hinged together at adjacent ends 34 and 36 (also referred to as hinge ends) thereof for movement of the closure members between open and closed positions. A latch 38 releasably holds the closure members 30 and 32 in their closed positions. The closure members 30 and 32 in their closed position (see FIG. 4, for example) together define an elongated aperture for receiving a media case to be secured with a close fit.

In one embodiment, one of the closure members 30 may include a generally planar elongated central portion 40, a hinge end portion 42 extending substantially perpendicularly from the central portion 40 at hinge end 34, and a latch end portion 44 extending substantially perpendicularly from central portion 40 at the latch end of the closure member. Similarly, the other of closure members 32 may include a generally planar elongated central portion 46, a hinge end portion 48 extending substantially perpendicularly from central portion 46 at hinge end 36, and a latch end portion 50 extending substantially perpendicularly from central portion 46 at the latch end of the closure member.

In one embodiment, closure members 30 and 32 have at their hinged ends 34 and 36 a protrusion 52 that projects into the narrow end of the elongated aperture defined by the closed closure members 30 and 32. As shown, for example in FIG. 4, the closure members may be latched closed around middle region 27 of media case 14. When security device 12 is closed around middle portion 27 of media case 14, protrusion 52 extends or otherwise projects into the cavity 28 of the media case (see FIG. 4, for example). The extending or otherwise projecting of the protrusion into the cavity of the media prevents the security device from sliding (inadvertently or intentionally) off of the media case, and therefore, prevents unintended removal of the security device from the media case. For example, if someone attempted to slide closed security device 12 off of media case 14, protrusion 52 would abut one of the ends of cavity 28, thereby preventing removal.

In one embodiment, hinge end portions 42 and 48 of closure members 30 and 32 may terminate at inturned hinge ear portions 54 and 56. The inturned hinge ear portions 54 and 56 may overlap and be connected together by a hinge pin. The inturned hinge portions may also connect together in a hinged configuration without the need for a hinge pin. In this embodiment, the inturned hinge ear portions 54 and 56 function as protrusion 52. Alternatively, other hinge configurations may be provided such as the integrally-molded hinge configuration shown in FIGS. 11-15. Such an integrally molded hinge configuration does not require the use of a separate hinge pin to function. Further, it is not necessary for the protrusion to be embodied in the hinged portions of the closure members. In such an embodiment, a separate inwardly extending protrusion may be attached to or integrally formed with the hinge end portions For example, the closure members may be hinged with one or more living hinges (with or without an accompanying hinge wall). In such an embodiment, the hinge end portions of the closure member may either not extend into the media case cavity or may extend away from the media case cavity.

Each closure member, including the central portion, the hinge end portion (including the inturned hinge ear portions), and the latch end portion may be formed of a unitary construction, for example, by molding the same from plastic material. Preferably, the closure members of the security device may be made from a substantially transparent material, such as polycarbonate. Alternatively, the security device may be made from a translucent material or a relatively opaque material. When the closure members are fabricated from a clear material, wall 50 may still be made from an opaque material to hide the operation of latch 38 from view.

Figure 16:
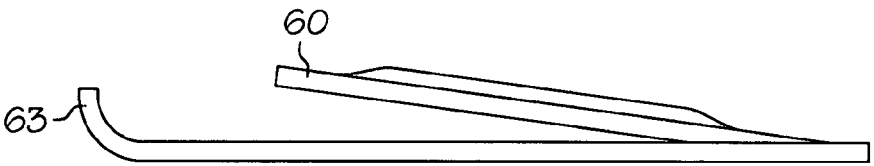
FIG. 16 is a side view of an alternative spring clip.
Figure 17:
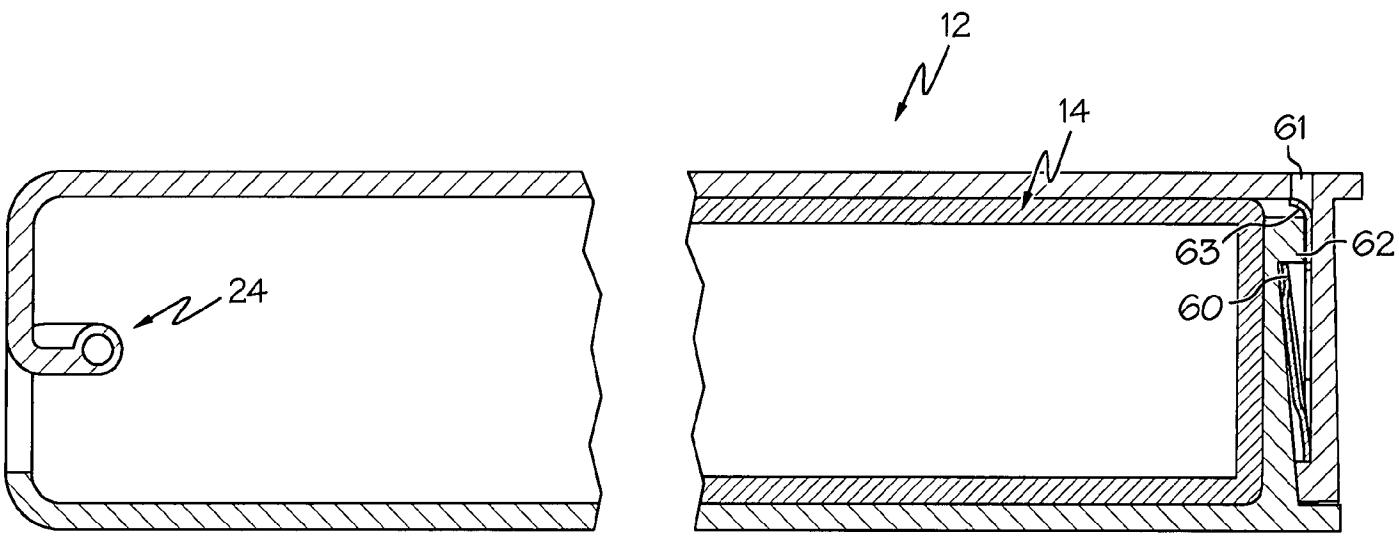
FIG. 17 is a section view showing the alternative spring clip locking the security device closed.

The latch 38 may include any suitable latching mechanism. For example, in one embodiment, the latch end portions 44 and 50 overlap when the closure members 30 and 32 are in their closed position. One latch end portion 50 on one closure member 32 is provided with spring clip including a resiliently biased finger 60 which engages a catch 62 on the latch end portion 44 of the other closure member 30. The latch may be arranged to automatically enter the locked state once the closure members are in their closed position. For example, the spring clip may be press fitted or otherwise secured in a pocket 64 in latch end portion 50 with the finger angled inwardly whereby, when the closure members are closed, the finger will be cammed outwardly by the catch until the end of the finger passes beyond the catch, whereupon it will spring inwardly to engage the catch. The catch 62 may be an integral part of at least one of the latch end portions of the closure members. Preferably, the resiliently biased finger is covered by the latch end portion of at least one of the closure members when the closure members are in their closed position to restrict access to the resiliently biased finger. FIGS. 16 and 17 depict an alternative spring clip wherein one end of the clip is curved inwardly (at numeral 63) so as to block any opening 61 that may be desired to mold the walls defining pocket 64.

Figures 12, 15:
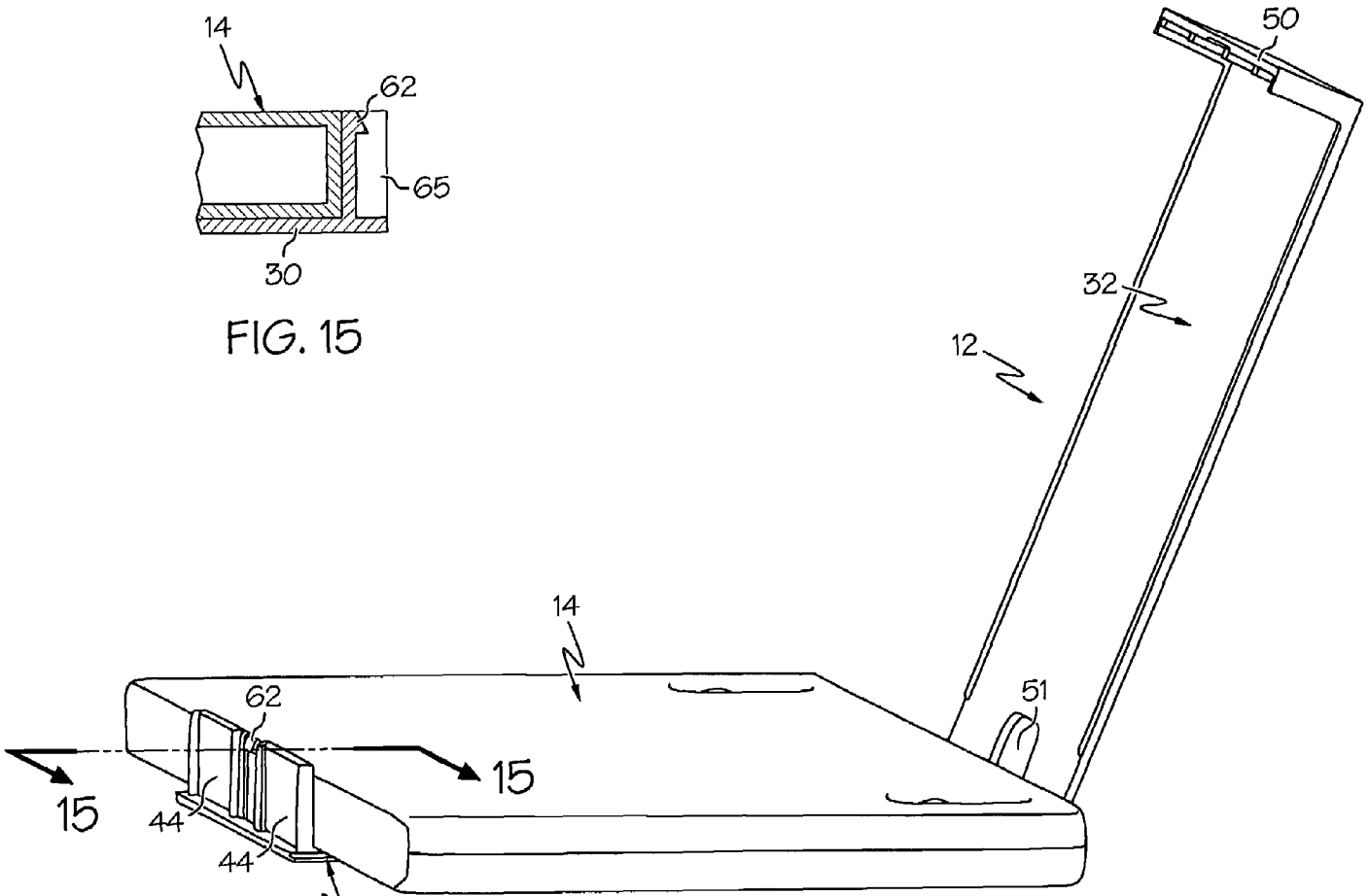
FIG. 12 is a perspective view showing a media case being inserted into the opening defined by one of the closure members to push the lock catch to its outer position.
FIG. 15 is a section view of the catch in its outward position.
Figure 13:
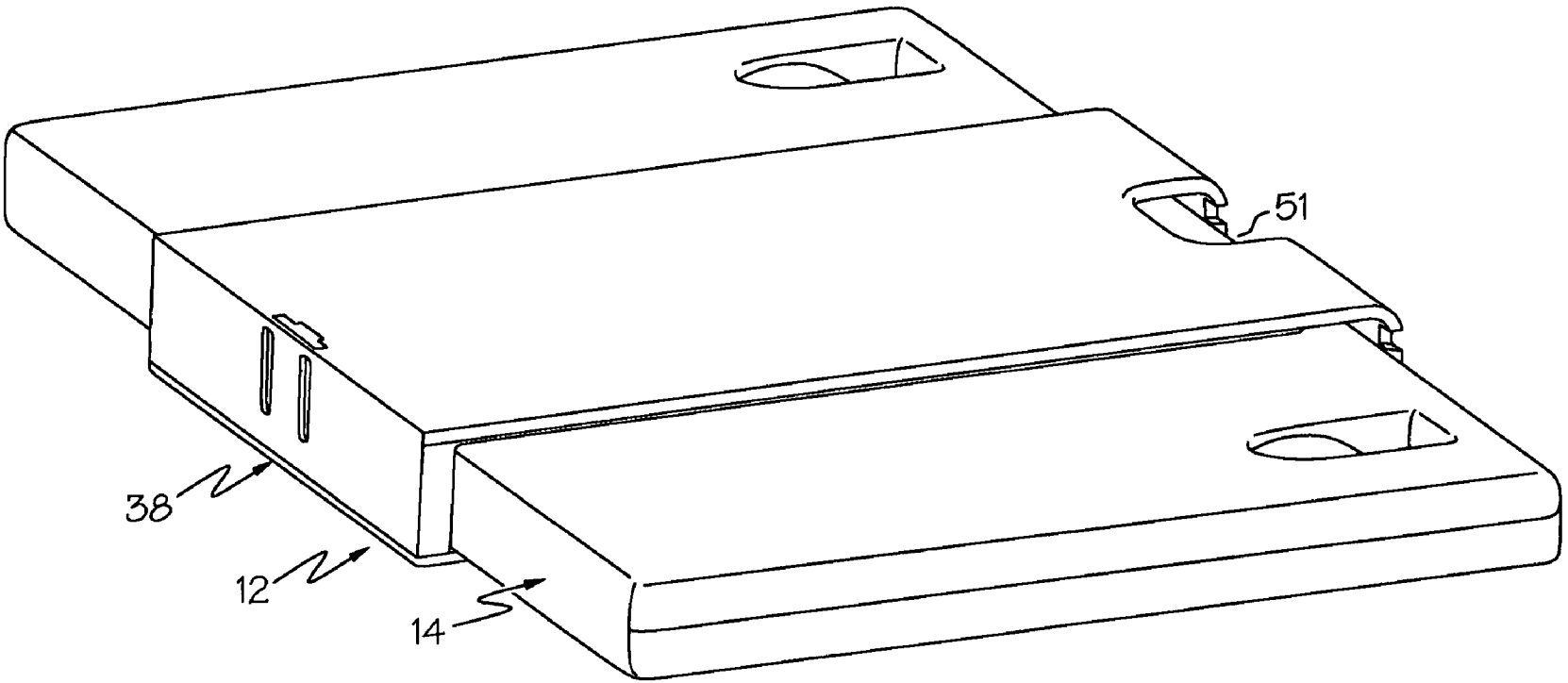
FIG. 13 is a perspective view of the security device in the closed and locked condition.

In an alternative configuration depicted in FIGS. 11-15, catch 62 is resiliently angled inwardly into the elongated aperture defined by closed closure members 30 and 32 so that device 12 will not lock when device 12 is not installed on case 14. In this position, catch 62 is out of alignment with lock finger 60 allowing device 12 to be closed, stored and shipped in an unlocked configuration. Catch 62 is pushed back into its outer position into alignment only when case 14 is inserted (as shown in FIG. 12) into the opening defined by member 30. Once catch 62 is back in its outer position and aligned with lock finger 60, device 12 will lock closed when member 32 is closed onto member 30 as shown in FIG. 13. Alternatively, the positions of lock finger 60 and catch 62 may be reversed so that lock finger 60 is biased to the inward position to prevent the locking of security device 12 unless media case 14 is inserted. In this configuration, latch end portion 44 is divided into at least two portions with catch 62 resiliently cantilevered from member 30 between end portions 44. A plurality of ribs 65 project outwardly from portion 44. A plurality of cooperating ribs 67 project inwardly from wall 50. Ribs 65 and 67 are disposed next to each other when members 30 and 32 are closed to increase the rigidity of device 12. End ribs 69 project inwardly from the ends of portion 50 to cover the ends of portions 44 when device 12 is closed. Ribs 65, 67, and 69 also shield latch 38 from attack.

The resiliently biased finger may be made of any suitable material. In one embodiment, the resiliently biased finger is made of any magnetically attractable material that provides suitable resiliency and is disposed such that placement of a magnet outwardly adjacent the latch end portions will, under magnetic force (such as from a magnetic key), move the resiliently biased finger from its latching position to its release position.

With reference now to FIGS. 5-10, an alternative configuration of a security device 12 is provided. As described above with respect to FIGS. 1-4, the security device 12 may include a pair of closure members 30 and 32. As described above, one of the closure members 30 may include a generally planar elongated central portion 40, a hinge end portion 42 extending substantially perpendicularly from the central portion 40 at the hinge end 34, and a latch end portion 44 extending substantially perpendicularly from the central portion 40 at the latch end of the closure member. Similarly, the other of the closure members 32 may include a generally planar elongated central portion 46, a hinge end portion 48 extending substantially perpendicularly from the central portion 46 at the hinge end 36, and a latch end portion 50 extending substantially perpendicularly from the central portion 46 at the latch end of the closure member.

In the confguration depicted in FIGS. 5-10, the hinge end portions 42 and 48 may each have laterally spaced-apart sections 43 and 49, which define or otherwise form a gap 51 between the laterally spaced-apart sections. The spaced-apart sections allow the security device to be used to secure media cases having an interrupted cavity 28 or with cases 14 that have a lock that is removed from case 14 in the location where gap 51 is disposed. Such an interruption may include, but is not limited to, a sidewall interruption in the cavity between the terminated ends of the cavity (effectively defining two or more cavities on the side of the media case opposite the hinged side). In this embodiment, the laterally spaced-apart sections of the hinge end portions together form protrusion 52 that extends inwardly into cavity 28 defined by the closed closure members into the media case. Otherwise, the operation of the security device 12 depicted in FIGS. 5-10 is the same as that of the security device depicted in FIGS. 1-4.

Figure 10:
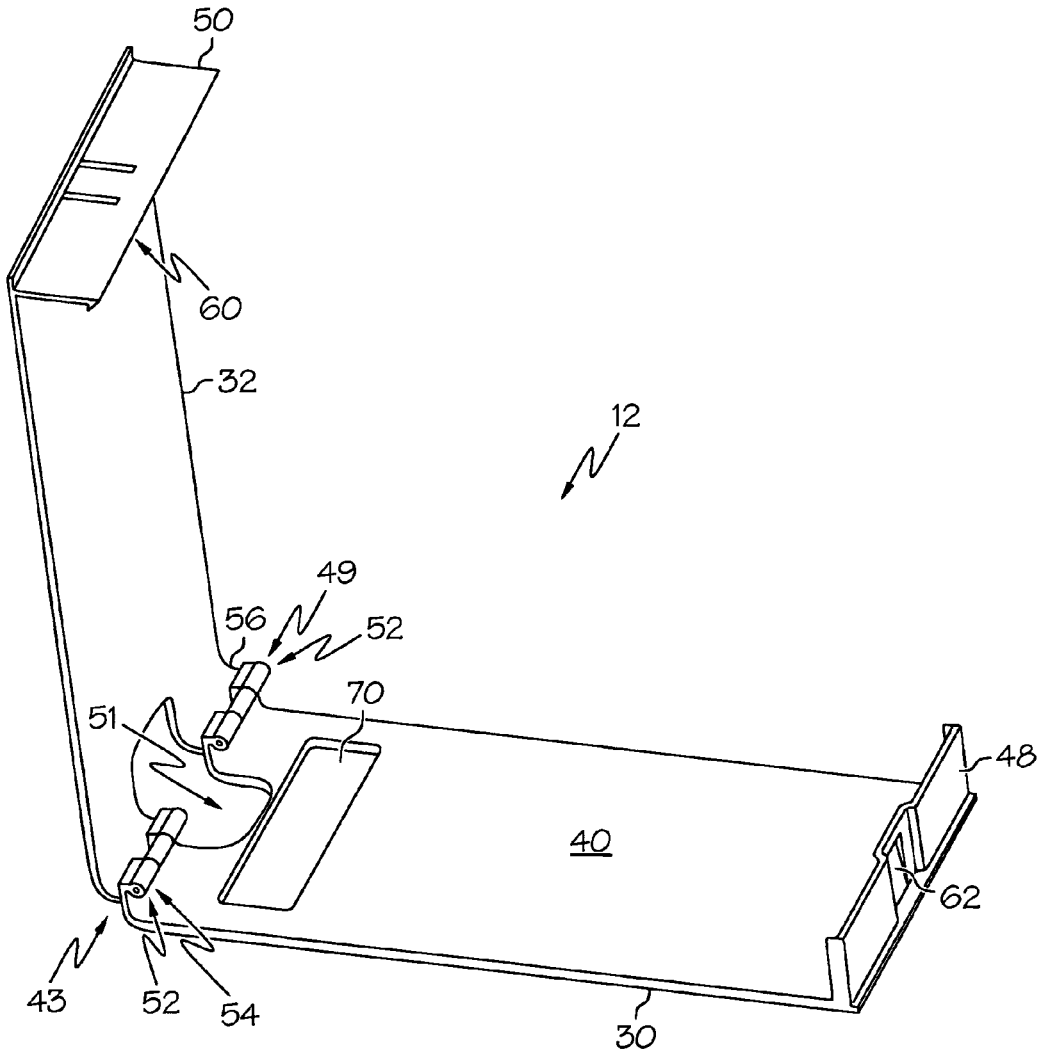
FIG. 10 is a perspective view of a security device in accordance with another exemplary embodiment of the present invention.
Figure 11:
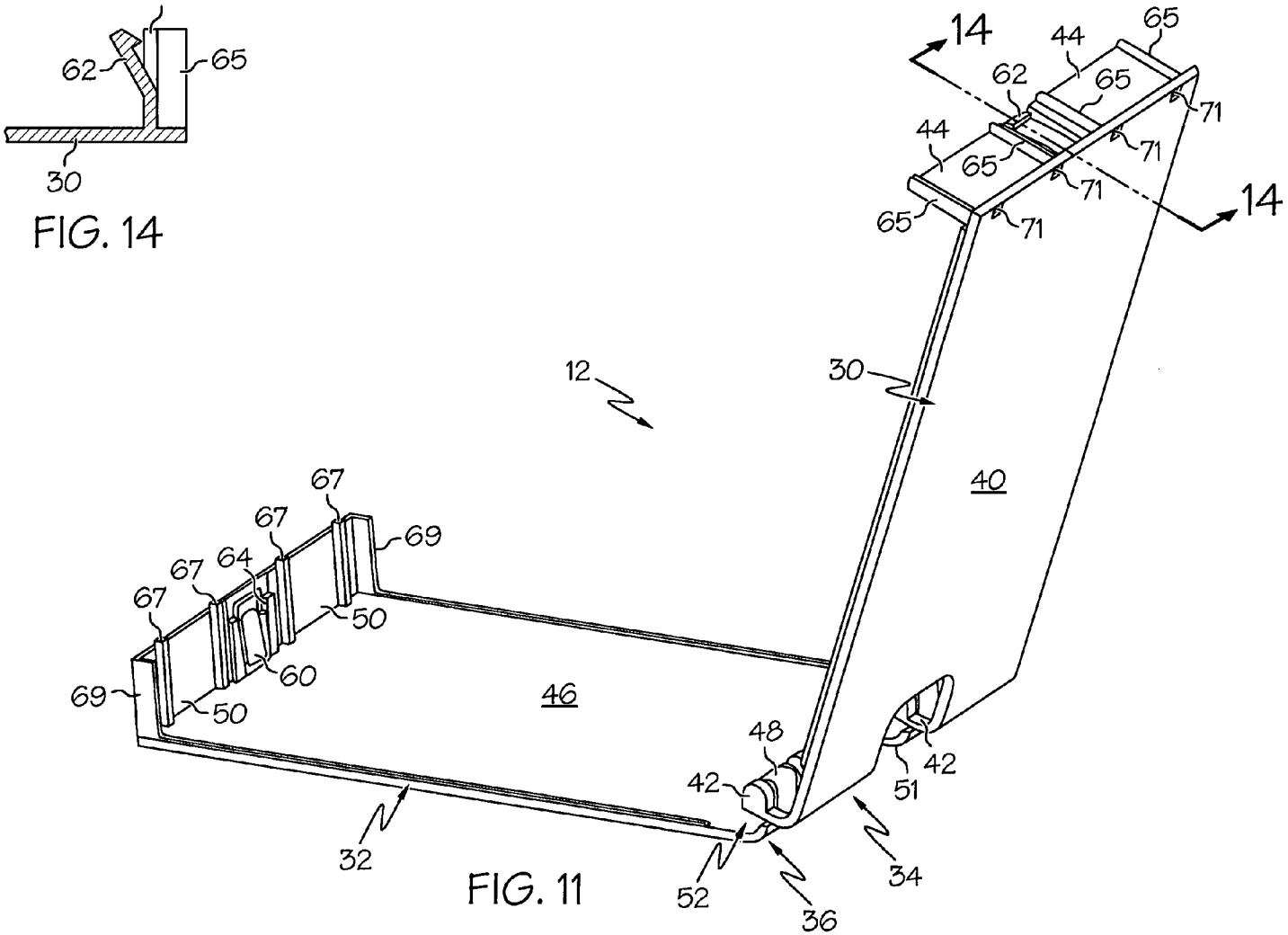
FIG. 11 is a perspective view of an alternative configuration for the security device of the invention with the closure members in their open positions and the lock catch in the its inward position.
Figure 14:
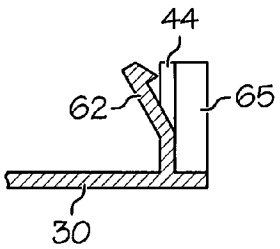
FIG. 14 is a section view of the catch in its inward position.

As illustrated in FIG. 10, one or both of the closure members 30 and 32 may include or otherwise define a recess 70 for containing or supporting an electronic surveillance device, such as an electronic article surveillance (EAS) tag. Artisans will appreciate that removal of an active EAS tag from a predetermined destination will cause the tag to signal an alarm or surveillance system, thereby serving as a theft prevention tool.

While the security device 12 depicted in FIGS. 1-4 is suitable for use with media cases having a substantially uninterrupted cavity 28, the security device 12 depicted in FIGS. 5-17 is suitable for use with media cases having an interrupted cavity 28 (such as a bifurcated cavity) as well as a substantially uninterrupted cavity 28. As will be appreciated, the gap at the hinge ends of the closure members may accommodate a locking element inserted into the cavity.

The security device described above in terms of exemplary embodiments may be unlocked or otherwise disengaged from the media case using a key 16. The key 16 may be a mechanical key, which provides direct mechanical actuation to move the resiliently biased finger from its latching position to its release position, a magnetic key, which as discussed above moves the resiliently biased finger from its latching position to its release position using a magnetic force, or some combination of a mechanical key and a magnetic key.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A security device for preventing opening of a media case that has two halves that are hinged together at one side of the case so that the case may be opened and closed, and which case has on the side thereof opposite its hinged side an elongated lock and/or finger cavity that is spaced inwardly from opposite ends of the case, the security device comprising:

a pair of closure members hinged together for movement of the closure members between open and closed positions; the closure members in their closed position together defining an elongated aperture for receiving a media case to be secured with a close fit; the elongated aperture having two opposite, open ends adapted to allow the media case to project through both open ends of the elongated aperture;

a latch for locking the closure members in their closed position; the latch adapted to secure the closure members in the closed position until unlocked with a key; and the closure members defining a protrusion that projects into the elongated aperture of the closure members where the protrusion is positioned to project into the elongated lock and/or finger cavity of the media case, whereby the closure members may be closed around a middle region of the media case when closed with the protrusion projecting into the elongated lock and/or finger cavity to prevent the security device from being slid off the media case.

2. The security device of claim 1, wherein the closure members each have a hinge end portion terminating at an inturned hinge ear portion that forms the protrusion that projects into the elongated lock and/or finger cavity to secure the security device from being slid off the media case.

3. The security device of claim 2, wherein the hinge end portions have laterally spaced-apart sections defining a gap therebetween.

4. The security device of claim 1, further comprising latch end portions projecting from the ends of the closure members opposite the hinged connection of the closure members.

5. The security device of claim 4, wherein the latch end portions of the closure members overlap one another when the closure members are in their closed position.

6. The security device of claim 4, wherein the latch includes a spring clip carried by one of the latch end portions for engaging a catch carried by the other of the latch end portions to prevent separation of the latch end portions when the closure members are in their closed position, the spring clip including a resiliently biased finger movable between a release position permitting separation of the latch end portions and a latching position for engaging the catch.

7. The security device of claim 6, wherein the catch is disposed in an inward position that prevents the spring clip from engaging the catch until the catch is moved to an outer position; the catch being movable to the outer position by the insertion of the media case in the closure member carrying the catch.

8. The security device of claim 6, wherein the resiliently biased finger is made of a magnetically attractable material and is disposed such that placement of a magnet outwardly adjacent the latch end portions will under magnetic force move the resiliently biased finger from its latching position to its release position.

9. The security device of claim 8, in combination with a key for unlocking the security device.

10. The security device of claim 9, wherein the key includes a magnet.

11. The security device of claim 6, wherein one end of the spring clip is curved; the closure member that carries the spring clip defining a latch opening that extends through the closure member and provides access to the curved end of the spring clip from outside of the security device; and the curved portion of the spring clip blocking the latch opening.

12. The security device of claim 1, wherein at least one of the closure members defines a recess adapted to receive an electronic article surveillance tag.

13. The security device of claim 1, wherein the latch has an inward position wherein at least a portion of the latch extends into the elongated aperture of the closure members; the inward position of the latch prevents the latch from securing the closure members until latch is moved to an outer position; the latch being movable to the outer position by the insertion of the media case in one of the closure members.

14. A releasable security device for preventing opening of a media case having two halves that are hinged together at one side of the case so that the case may be opened and closed, and which case has on the side thereof opposite its hinged side an elongated lock and/or finger cavity that is spaced inwardly from opposite ends of the case, the security device comprising first and second closure members movable between open and closed configurations; in the closed configuration, the first and second closure members defining a substantially rectangular aperture for receiving the media case to be secured with a close fit, the rectangular aperture having two opposite, open ends adapted to allow the media case to project through both open ends of the elongated aperture; the closure members including an internal protrusion extending within the elongated lock and/or finger cavity of the media case when the closure members are closed about the media case to prevent the security device from being slid off the media case, and a latch opposite the side including the internal protrusion.

15. The security device of claim 14, wherein the closure members are hinged together with a hinge; the hinge defining the internal protrusion.

16. The security device of claim 14, wherein the latch has an inward position that prevents the latch from engaging until the latch is moved to an outer position; the latch being movable to the outer position by the insertion of the media case in one of the closure members.

17. The security device of claim 14, wherein the latch includes a resiliently biased, cantilevered finger made of a magnetically attractable material; the latch being disposed such that placement of a magnet outwardly adjacent the latch will under magnetic force move the resiliently biased finger from its latching position to its release position.

18. The security device of claim 17, in combination with a key for unlocking the security device; the key having a magnet.

* * * * *